US006578788B2

(12) United States Patent
Rodriguez et al.

(10) Patent No.: US 6,578,788 B2
(45) Date of Patent: Jun. 17, 2003

(54) ACCUMULATOR AND DISPENSING SYSTEM FOR A CUTTING TAPE

(76) Inventors: Peter A. Rodriguez, 13612 McQueens Ct., Jacksonville, FL (US) 32225; Thomas B. Middlebrooks, 315 19th St. North, Jacksonville Beach, FL (US) 32250

( * ) Notice: Subject to any disclaimer, the term of this patent is extended or adjusted under 35 U.S.C. 154(b) by 0 days.

(21) Appl. No.: 10/008,758

(22) Filed: Nov. 8, 2001

(65) Prior Publication Data

US 2003/0085315 A1 May 8, 2003

(51) Int. Cl.[7] ..... B65H 19/26
(52) U.S. Cl. ..... 242/526.2; 242/542.3
(58) Field of Search ..... 242/526.2, 542.3

(56) References Cited

U.S. PATENT DOCUMENTS 4,659,029 A * 4/1987 Rodriguez ..... 242/526.2
4,783,018 A * 11/1988 Rodriguez ..... 242/526.2
5,046,675 A * 9/1991 Rodriguez ..... 242/526.2

* cited by examiner

*Primary Examiner*—Kathy Matecki
*Assistant Examiner*—Sang Kim

(74) *Attorney, Agent, or Firm*—Arthur G. Yeager

(57) ABSTRACT

An accumulator roll and a dispensing system for a cutting tape into a cross web track of an apparatus for cutting a moving web of paper includes first and second driving rolls for moving the tape into an entryway of a container and having a cutting station between them to cut a predetermined single length of a cutting tape, the container includes a hollow formed by a circumferential surface in which the entryway is located and having a lateral slot therein located spacedly from the entryway, the hollow is formed by a plate extending laterally of the circumferential surface and having an arcuate slot generally medially of the plate, a press roll extending through the lateral slot beyond the circumferential surface, an accumulator roll having a rotating first shaft extending through the arcuate slot with accumulator roll being within the hollow and located adjacent to and urged toward the press roll for receiving the tape therebetween and wrapping the tape around accumulator roll, which is rotating at a speed higher than the linear speed of the tape entering the entryway, the accumulator roll is increased in diameter by the tape wound therearound causing first shaft to move within arcuate slot, the second driving roll maintaining a cut end portion of the tape therebetween with substantially its remainder wound on accumulator roll, the second driving roll pulling a free end of tape wound around the accumulator roll out of the entryway into the cross web track of the apparatus for cutting a moving web, and applying an adhesive strip to the tape thereof

32 Claims, 5 Drawing Sheets

ACCUMULATOR AND DISPENSING SYSTEM FOR A CUTTING TAPE

CROSS REFERENCE TO RELATED APPLICATION

This application is related to an U.S. application Ser. No. 10/008,756 entitled Roll of Adhesive Labels for Cutting Tape, filed on even date herewith, and to application Ser. No. 10/008,757 entitled Adhesive Applicator.

BACKGROUND OF THE INVENTION

1. Field of the Invention

The present invention relates to a system and a method for loading a pre-determined amount of band or tape from a roll sufficient for an entire turn-up process. In particular, the present invention relates to a system for dispensing a pre-determined length of a cutting tape into a cross web track of an apparatus for cutting a moving web of paper.

2. Related Art

The proper length of a cutting tape is primarily determined by the width of the web and the width of a cross web track and an extra length of tape needed to properly spiral onto empty paper reel to which the web is transferred.

In the prior art systems, see for example U.S. Pat. No. 5,046,675 dated Sep. 10, 1991, a loop was formed prior to cutting a tape to its correct length. The paper machine pulls the reserve or extra tape from a longitudinal slot during turn-up. Some processing difficulties may arise during such operation. The tape is highly tensioned and may present problems in fast paper machines. Accordingly, there is a need for an improved dispensing and accumulating cutting tape system that enables smooth tangential release of the cutting tape into a cross web track of paper machine and provides a pre-determined single length of the cutting tape before sending it into the cross web track.

It is an object of the present invention to provide an accumulator of a cutting tape that winds and stores a pre-determined length of a cutting tape ready to be dispensed outwardly into a cross web track.

It is another object of the present invention to provide an accumulator of a cutting tape having a roll rotating inside the accumulator at a speed faster than the speed of a cutting tape entering the accumulator to wind the cutting tape around the roll.

It is a further object of the present invention to provide an accumulator of a cutting tape having a roll rotating inside the accumulator and coupled to a clutch mechanism to vary its speed inversely proportional to the speed of the cutting tape winding on the roll.

It is an additional object of the present invention to provide for an accumulator of a pre-determined length of a cutting tape to be dispensed at an appropriate selected time and an adhesive applicator to apply a double-sided pressure sensitive adhesive, preferably paper, strip to a lower surface of the cutting tape prior to entering a cross web track.

It is a related object of the present invention to provide for an accumulator and an adhesive applicator dispensing system including a sensor to detect presence or absence of an adhesive strip on a lower surface of a cutting tape and an abort block to divert a cutting tape having no adhesive strip.

Still another object of the present invention is to provide for an improved dispensing and accumulating cutting tape system that enables smooth tangential release of the cutting tape into a cross web track beneath paper machine.

BRIEF SUMMARY OF THE INVENTION

The present invention relates to a system for dispensing a pre-determined single length of a cutting tape into a cross web track of an apparatus for cutting a moving web. The system includes a first driving roll and a first press roll selectively movable toward and away from the first roll by an actuator. The first roll and first press roll sandwich a cutting tape therebetween when the first press roll is moved toward the first roll and causes a cutting tape to be passed through a cutting station. A second driving roll and a second press roll selectively moves toward and away from the second roll by an actuator with the second driving roll being operatively coupled to the first driving roll. The second press roll receives a cutting tape after passage through the cutting station with a cutting tape being sandwiched between the second roll and the second press roll for moving a cutting tape in one direction into an entryway of a container. The container includes a hollow therein formed by a circumferential surface in which the entryway is located. The circumferential surface has a lateral slot therein located spacedly from the entryway, and the hollow being formed by a plate extending laterally of the circumferential surface. The plate has an arcuate slot extending at its inner end generally medially of the plate to its outer end adjacent the lateral slot. A rotatable press roll has a fixed axis of rotation with its outer surface extending partially through the lateral slot beyond the circumferential surface of the hollow, and an accumulator roll having a rotating first shaft extends through the arcuate slot with the accumulator roll being within the hollow and being located adjacent to and urged toward the rotatable press roll for receiving a cutting tape therebetween and wrapping a cutting tape around the accumulator roll. The accumulator roll rotates at a speed greater than the linear speed of a cutting tape entering the entryway, and the accumulator roll increases in diameter by a cutting tape being wound therearound causing the first shaft to move from the outer end of the arcuate slot toward the inner end. The second driving roll and the press roll maintain a cut end portion of a cutting tape therebetween with substantially its remainder wound on the accumulator roll, and the second driving roll moving a cutting tape in another direction opposite to the one direction to pull a cutting tape from around the accumulator roll in a clockwise direction out of the entryway. A clutch mechanism coupled to the accumulator first shaft varies speed of rotation of the roll in an inverse proportion relative to the diameter of tape wound around the accumulator roll.

The system further includes a third driving roll and a third press roll selectively movable toward and away from the third roll by an actuator, while the third roll and third press roll sandwich a cutting tape therebetween when the third press roll is moved toward the third roll and moves a cutting tape through a cross web track of an apparatus for cutting a moving web, and the third driving roll being operatively coupled to the first and second driving rolls. A reversible motor is positioned spacedly upstream from the third driving roll and being coupled to the first, second and third driving rolls for providing rotative power thereto.

A fourth roll rotatable in either direction to assist the second driving roll in moving a cutting tape inwardly and outwardly of the entryway is positioned adjacent the entryway and spaced from the second driving roll.

An adhesive applicator to apply a strip of double-sided pressure sensitive adhesive to a lower surface of a cutting tape is also included in the system. The applicator is positioned upstream from the third driving roll and includes a housing having an upper portion and a lower portion, a rotatable spindle for receiving a supply roll having layers of spaced strips with exposed face sides and unexposed back sides with each side having a pressure sensitive adhesive thereon and with back sides being adhered to an elongated continuous release liner. The spindle is positioned generally medially of the upper portion, a stationary nose member is mounted to the housing and has a rounded tip exposed outwardly of the housing and is disposed at a proximal end of the upper portion of the housing above the spindle and supply roll is disposed thereon. A solenoid activated press roll is positioned diametrically opposite and above the rounded tip and is vertically movable downwardly to force an exposed face side of an adhesive strip located on release liner located on the rounded tip into contact with a lower surface of a generally horizontally incoming cutting tape to cause an exposed face side to adhere to a lower surface of a cutting tape and separate from a release liner when a release liner rotates around the tip. The applicator also includes a rotatable nip roll spacedly positioned beneath a supply roll for pressing spent release liner onto a supply roll, a doctor knife edge is positioned spacedly and adjacent the nip roll and beneath the supply roll for separating spent release liner from exposed face sides of strip around a supply roll while the nip roll presses against a supply roll. An optical sensor upstream from the stationary nose member controls the movement of the press roll downwardly to press into contact a lower surface of a cutting tape with an exposed face side. Another optical sensor is positioned in proximity with and downwardly from the stationary nose member for detecting presence or absence of adhesive on a lower surface of a generally horizontally exiting cutting tape, and an abort block means is selectively movable downwardly, and a controller receives output signals from the sensor and sends a signal to the abort block means to move downwardly to divert a cutting tape having no adhesive strip on its lower surface.

The present invention also relates to a method for accumulating a pre-determined single length of a cutting tape and dispensing a free end of a cutting tape into a cross web track of an apparatus for cutting a moving web, the method comprises the steps of moving a cutting tape into an entryway of a container having a hollow therein formed by a circumferential surface in which the entryway is located; sandwiching a cutting tape between a rotatable fixed axis press roll with its outer surface extending partially through a lateral slot formed in the circumferential surface beyond such surface and an accumulator roll; driving the accumulator roll through a shaft extending through an arcuate slot in the container with an inner end of the slot being medially of the hollow and an outer end being adjacent the lateral slot; wrapping a cutting tape around the accumulator roll within the hollow; increasing the effective diameter of the accumulator roll by a cutting tape being wound therearound; and urging the shaft of the accumulator roll to move from the outer end of the arcuate slot toward the inner end; adjusting the speed of the accumulator roll relative to the linear speed of the cutting tape; urging the shaft of the accumulator roll toward the press roll during the step of wrapping the cutting tape around the accumulator roll; advancing a free end of a cutting tape wound around the accumulator roll into the cross web track of the apparatus for cutting a moving web and unwinding the wound cutting tape from the accumulator roll; applying a double-sided pressure sensitive adhesive strip to a lower surface of a cutting tape prior to a cutting tape entering the cross web track; detecting the presence or absence of pressure sensitive adhesive strip on the lower surface of the cutting tape; and downwardly moving an abort block to divert an incoming cutting tape having no adhesive strip on its lower surface.

BRIEF DESCRIPTION OF THE DRAWINGS

The novel features believed to be characteristic of this invention are set forth with particularity in the appended claims. The invention itself, however, both as to its organization and method of operation, together with further objects and advantages thereof, may best be understood by references to the following description taken in connection with the accompanying drawings in which:

DETAILED DESCRIPTION OF THE INVENTION

Figure 1:
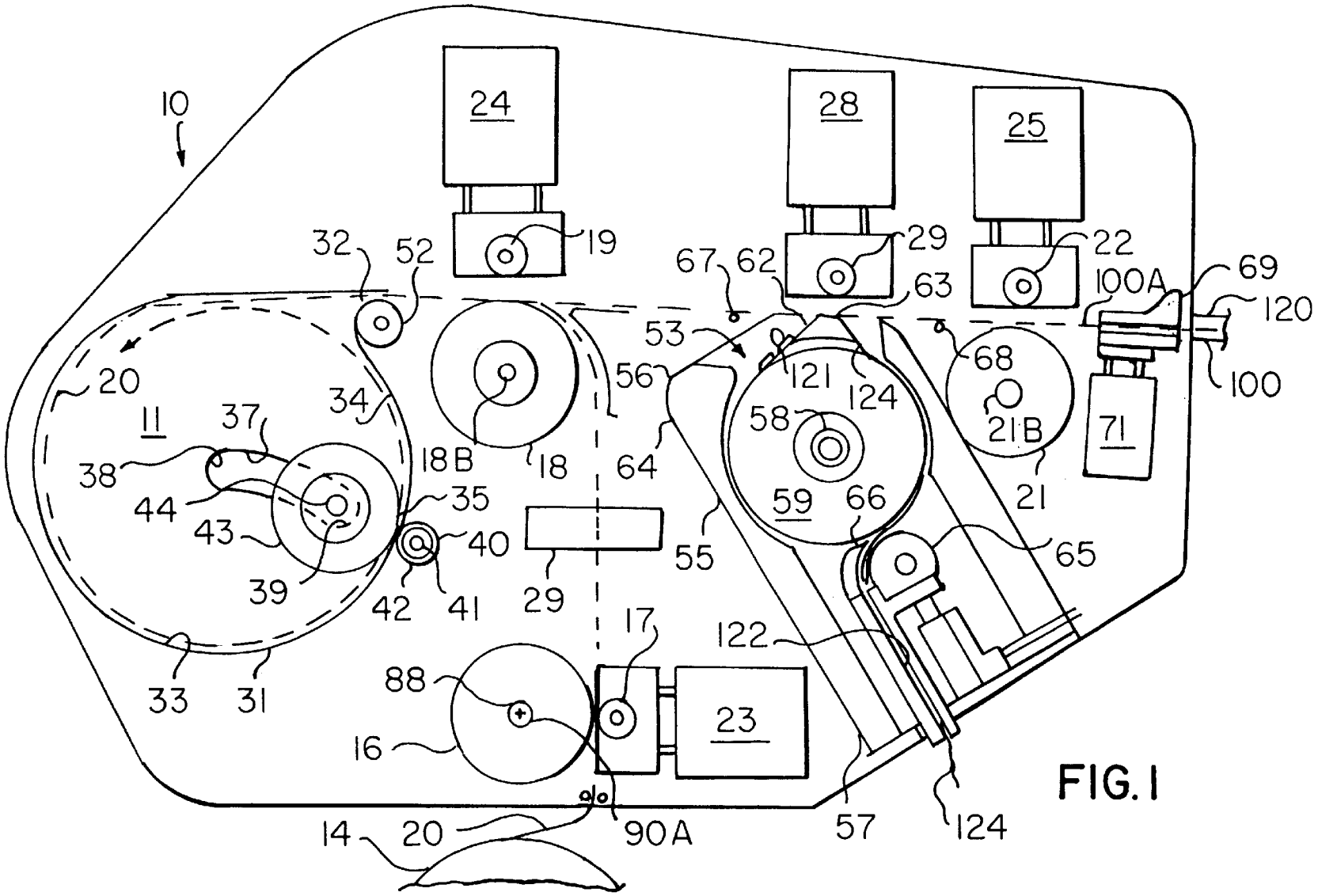
FIG. 1 is a front side elevational view of the system for dispensing a pre-determined single length of a cutting tape in accord with the present invention.

FIG. 1 shows the system 10 of the present invention for dispensing a pre-determined single length of a cutting tape 20 into a cross web track 100 of an apparatus for cutting a moving web as known in the prior art. A storage supply roll 14 contains wound layers of cutting tape 20 to be fed between a first driving roll 16 and a first cooperating press roll 17 of system 10 of the present invention. The first press roll 17 is movable by an actuator 23, which may be a solenoid, toward and away from the first driving roll 16 to sandwich the cutting tape 20 therebetween to advance the cutting tape 20 through a cutting station 29 and thence to a second driving roll 18. The cutting station 29 is spaced upwardly from the first driving roll 16 and the first press roll 17 and is responsive to an output signal to cut a pre-determined single length of the cutting tape 20 passing roll 18 at an appropriate number of rotation thereof The second driving roll 18 is positioned upwardly from the cutting station 29 and includes control means, not shown, that calculates the appropriate single length of the cutting tape 20 to be cut at the cutting station 29 and sends a signal to the cutting station 29 to cut the tape 20 at a determined length of tape to end at driving roll 18. The second driving roll 18 rotates in either clockwise direction to forward the cutting tape 20 into an entryway 32 of a container 31 or counterclockwise direction to pull the cutting tape 20 away from the container 31. A second press roll 19 is positioned above the second driving roll 18 and is movable toward and away from the second driving roll 18 by a second actuator 24 to sandwich the cutting tape 20 therebetween.

A fourth entryway roll 52 rotatable in counterclockwise direction assists in forwarding the cutting tape 20 inside a hollow 33 of the container 31 or in clockwise direction when the tape 20 is pulled out of the container 31. The fourth entryway roll 52 is positioned adjacent the entryway 32 of the container 31 and minimizes any frictional wear on the circumferential surface 34 during counterclockwise pull extended on tape 20.

The hollow 33 of the container 31 is formed by joining a circumferential surface 34, in which the entryway 32 is located, and a plate 11 that extends laterally of the circumferential surface 34. The circumferential surface 34 has a lateral slot 35 located downwardly from the entryway 32. A rotatable press roll 40 has a fixed axis of rotation 41 and its outer surface 42 extends partially through the lateral slot 35 beyond the circumferential surface 34 of the hollow 33. An arcuate slot 37 is positioned medially within the plate 11 and has an outer end 39 in proximity of the lateral slot 35 and press roll 40 and an inner end 38 medially of the plate 11 and medially of circumferential surface 34. An accumulator roll 43 in the hollow 33 has a rotating shaft 44 that extends through the arcuate slot 37 and rotates the accumulator roll 43 with the shaft 44 being movable between the outer end 39 of the arcuate slot 37 and its inner end 38. The shaft 44 is supported on a swing arm 85, best shown in FIG. 4, which permits the accumulator roll 43 with its shaft 44 to move in an arc back and forth within slot 37.

As the tape 20 is advanced into the hollow 33 of the container 31, the accumulator roll 43 rotates with the shaft 44 disposed at outer end 39 of the arcuate slot 37 to press an upper surface of incoming tape 20 against the outer surface 42 of the roll 40 to assist the tape 20 in moving around the circumferential surface 34. The accumulator roll 43 is designed to rotate faster than the linear speed of the tape 20 to cause the tape 20 after several turns within container 31 to wind around the accumulator roll 43. As the tape 20 winds around the accumulator roll 43, its diameter 45 increases causing the swing arm 85 to move the accumulator roll 43 with its shaft 44 disposed in the outer end 39 toward the inner end 38 of arcuate slot 37.

When the control means of the second driving roll 18 determines that the pre-determined required single length of cutting tape 20 has been reached, the control means sends a signal to the cutting station 29 to cut the tape 20, while the second driving roll 18 continues to rotate to push the tape 20 into the hollow 33 and around the accumulator roll 43. The cutting station 29 divides the tape 20 between a pre-determined single length wound around the accumulator roll 43 and a free end trailing end being moved to its position as a forward free end and a new forward end of the next cutting tape held at the cutting station 29 ready to be advanced to the second driving roll 18 and into the container 31 and thence dispensed when an operator decides it is time to do so. The second driving roll 18 continues to rotate after the cutting of the tape 20 until the free end of the tape 20 is held and sandwiched between the second driving roll 18 and the second press roll 19.

When an operator decides to release the tape 20, the second driving roll 18 rotates in a clockwise direction to move the tape 20 out of the entryway 32 causing the fourth entryway roll 52 to rotate clockwise to pull the tape 20 from around the accumulator roll 43 and out of the hollow 33 exiting the entryway 32. The tape 20 is advanced through the guideway represented by broken line 100A until it passes adjacent an optical sensor 67 that detects the movement of the end of tape 20, which passes between a press roll 29 and a stationary nose member 62 of an adhesive applicator 53. The applicator 53 includes a housing 55, which has an upper portion 56 and a lower portion 57, a rotatable spindle 58 for receiving a supply roll 59 and has layers of spaced strips 121 with exposed face sides and unexposed back sides and each side has a pressure sensitive adhesive thereon and the back sides are adhered to an elongated continuous release liner 124, which has a release coating on both its faces. The spindle 58 is positioned generally medially of the upper portion 56. The stationary nose member 62 is mounted to the housing 55 and has a rounded tip 63 exposed outwardly of the housing 55 and is disposed at a proximal end 64 of the upper portion 56 of the housing 55 above the spindle 58 and a supply roll 59 disposable thereon. A solenoid activated press roll 29 is positioned diametrically opposite and above the rounded tip 63 and is vertically movable downwardly to force the exposed face side of the adhesive strip 121 on the rounded tip 63 into contact with a lower surface of a generally horizontally incoming cutting tape 20 to cause the exposed face side to adhere to the lower surface of the tape 20 and separate from the release liner 124 when the release liner 124 rotates around the tip 63. A rotatable nip roll 65 is spacedly positioned beneath the supply roll 59 for pressing spent release liner 124 onto the supply roll 59. A doctor knife edge 66 is positioned spacedly and adjacent the nip roll 65 and beneath the supply roll 59 for separating spent release liner 124 from exposed face sides of strip 121 around the supply roll 59 and forwarding it to a waste channel 122, while the nip roll 65 presses against the supply roll 59. The optical sensor 67 controls the movement of the actuator 28 that pushes the press roll 29 toward and away from the stationary nose member 63 to press a lower surface of an incoming cutting tape 20 into contact with an exposed face side of double sided pressure sensitive adhesive paper strip to apply an such strip to the cutting tape 20. The process and the adhesive applicator 53 are described in detail in U.S. Application entitled Adhesive Applicator, which is filed on even date herewith. After the adhesive strip is applied to the tape 20, it passes adjacent an optical sensor 68 that detects the presence or absence of adhesive strip on the tape 20. Thereafter, the tape 20 is moved forward so that the adhesive strip, if present, is forward of and sandwiched between a third driving roll 21 and a third press roll 22 movable away and toward the third driving roll 21 by a third actuator 25. An abort block 69 awaits the tape 20 before the beginning 120 of the cross track 100A. If the sensor 68 detects the absence of adhesive strip on the tape 20, the sensor 68 sends a signal to controller 71 to cause the abort block 69 to move downwardly to intercept the tape 20 and divert it to a waste zone. The process is also described in more detail in the above-identified U.S. Application entitled Adhesive Applicator.

Figure 2:
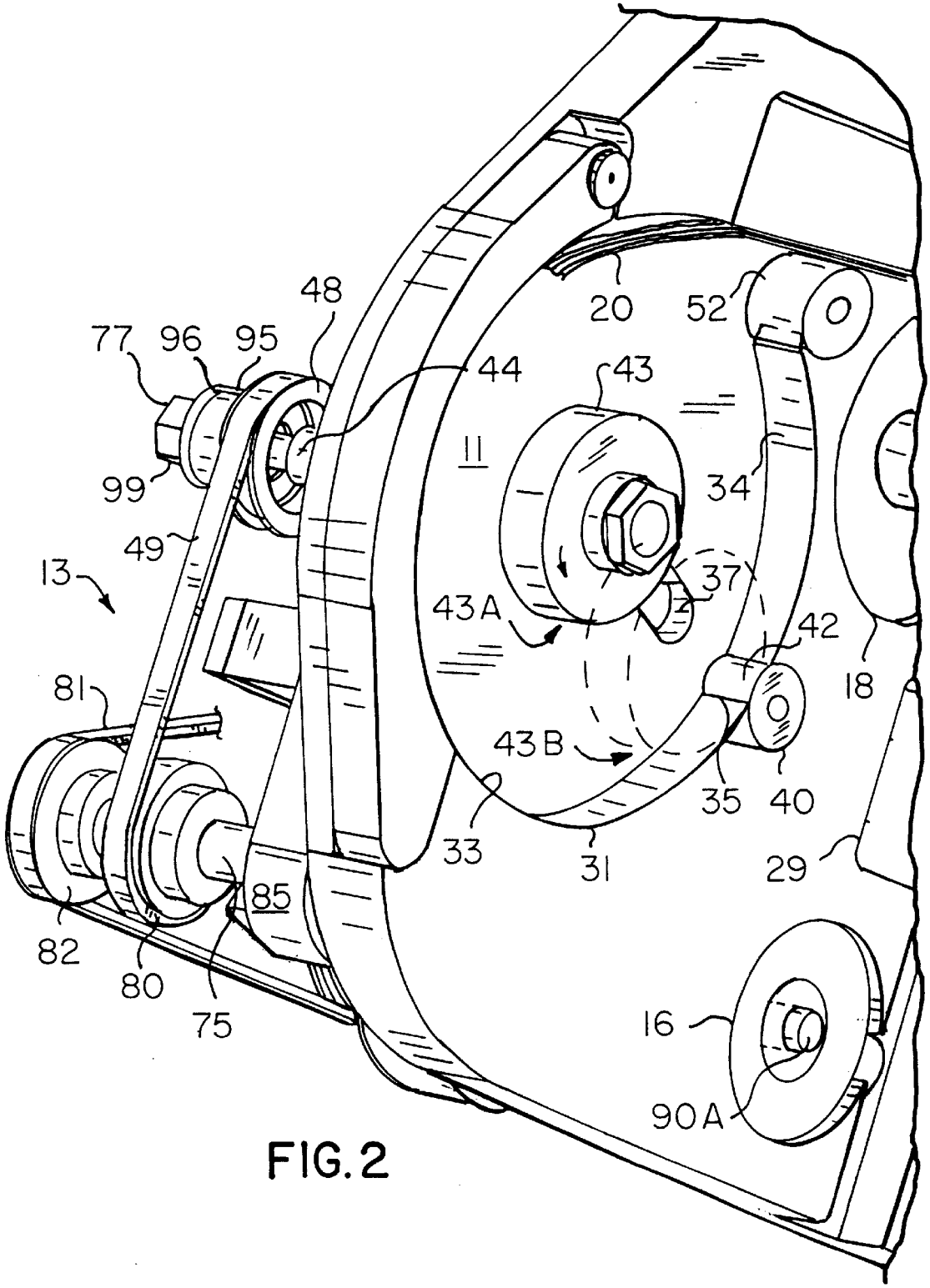
FIG. 2 is an isometric view showing the container and the accumulator roll in detail.

FIG. 2 shows the container 31 in greater detail and a portion of the back driving side 13 of the system 10. The hollow 33 of the container 31 is formed by joining the plate 11 with circumferential surface 34, which may be integral. The circumferential surface 34 includes lateral slot 35 and press roll 40 rotating so as the tape 20 is fed around surface 34. Roll 40 has its outer surface 42 extending above surface 34 in the slot 35. The accumulator roll 43, which is mounted on the first shaft 44, is shown with shaft 44 pivotally moving within the arcuate slot 37 between its inner end 38 as in position 43A and its outer end 39 as in position 43B. The swing arm 85, which is coupled to the first shaft 44 and a parallel second shaft 75, best shown in FIG. 4, causes the accumulator roll 43 to move from position 43A to 43B when the roll 43 is urged to move by effective increase in diameter by winding accumulating layers of the tape 20 around the roll 43 when the tape 20 is feeding into the container 31. When the accumulator roll 43 is pushed to position 43A, spring means 60, shown in FIGS. 3 and 4, urge the accumulator roll 43 as it decrease in its effective diameter by pulling the accumulated tape off to move back to position 43B again to receive the next pre-determined single length of cutting tape 20 to be wound around the roll 43.

Figure 3:
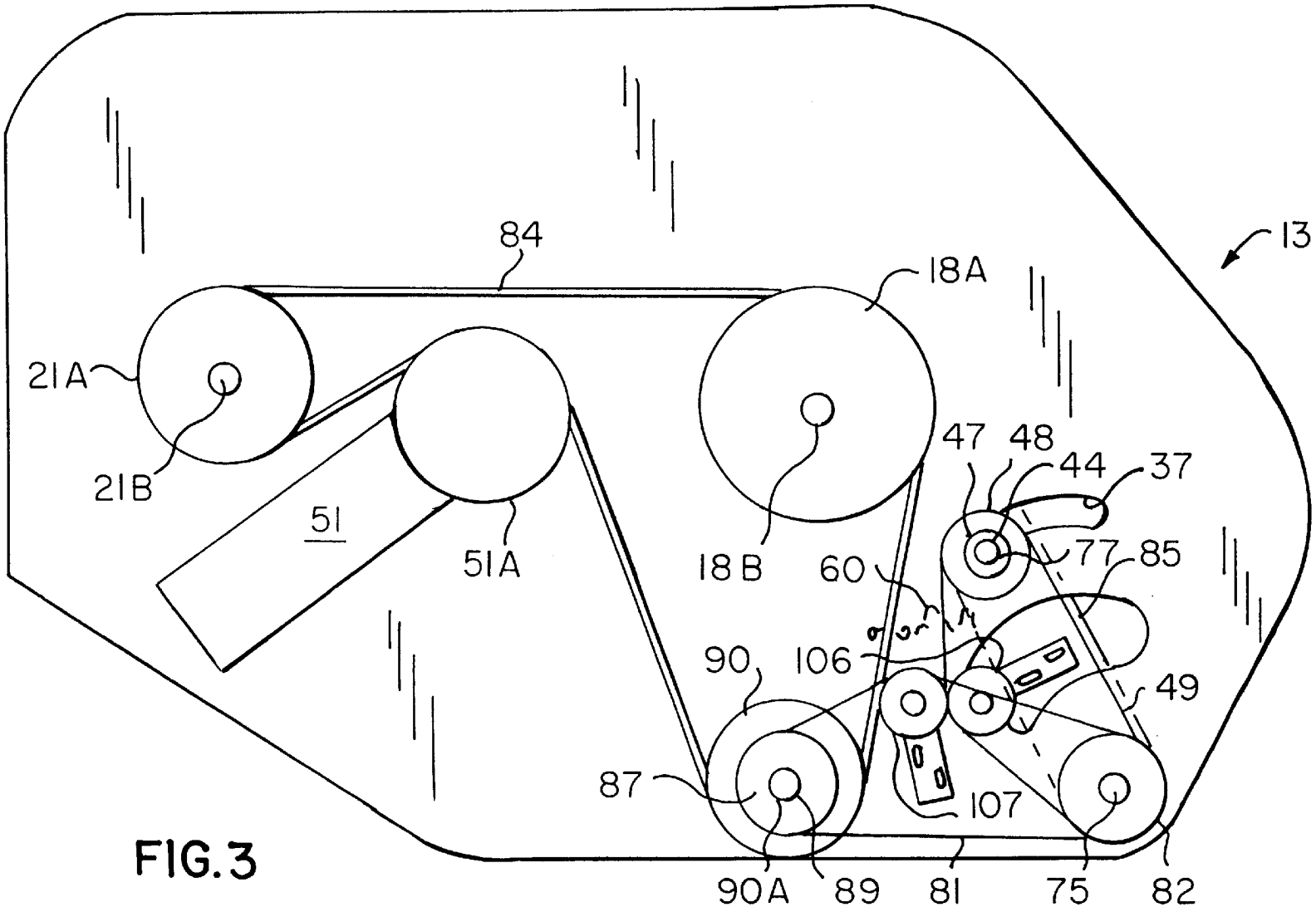
FIG. 3 is a rear side elevational view of the system in accord with the present invention.

FIG. 3 shows the back driving side 13 of the system 10. Reversible motor 51 drives a rotatable pulley 51A to provide rotative power to the first driving roll 16, the second driving roll 18, and the third driving roll 21. Main driving belt 84 is engaged with pulley 51A, pulley 90 rotates shaft 90A and its connected roll 16; pulley 18A which rotates shaft 18B and its connected roll 18, pulley 21A rotates shaft 21B and its connected roll 21 all in serpentine passage of belt 84.

Figure 4:
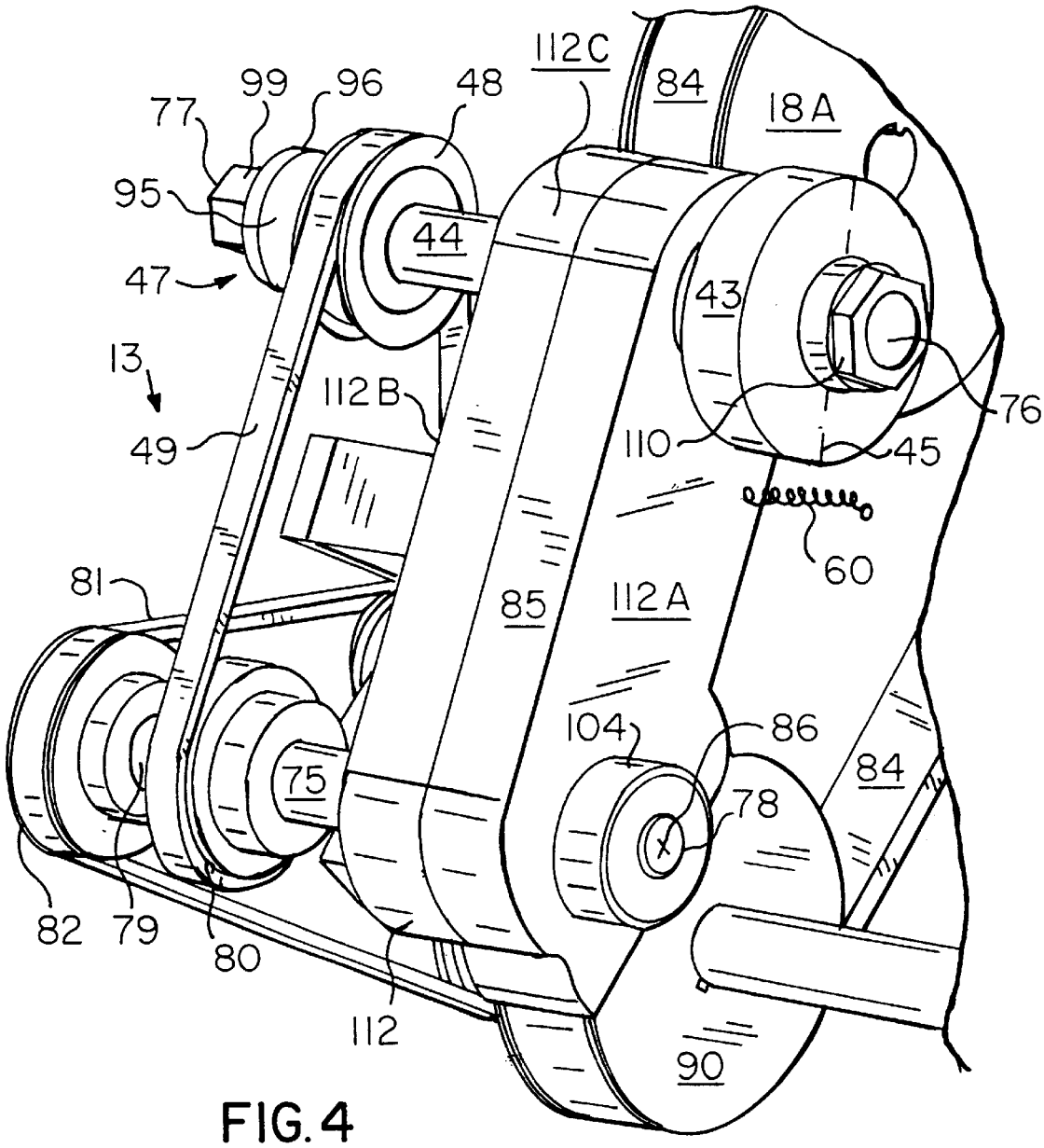
FIG. 4 is an isometric view similar to FIG. 2 showing the swing arm and other components in greater detail.
Figure 5:
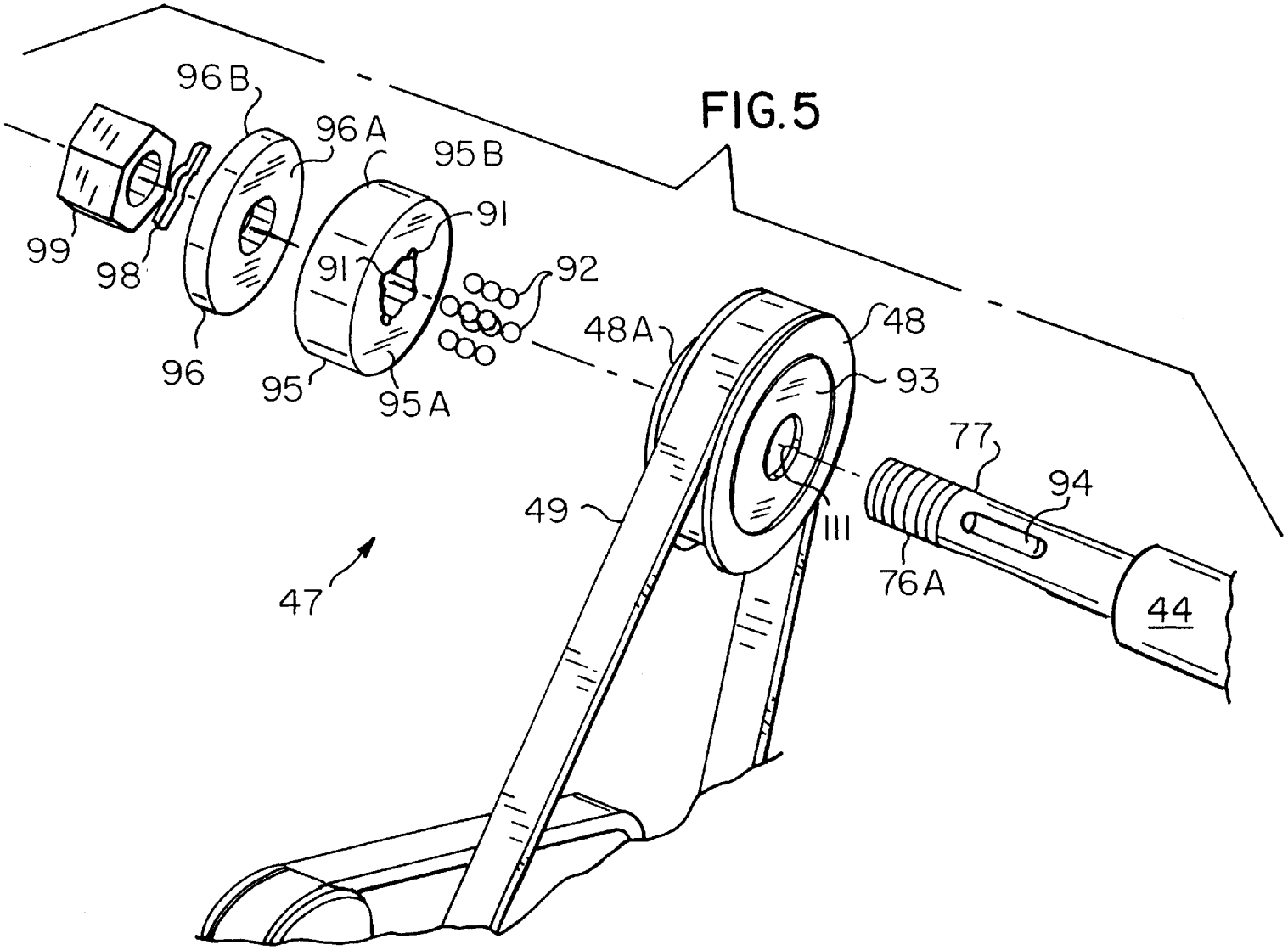
FIG. 5 is an extended view of the clutch mechanism in accord with the present invention.

The first pulley 48 is shown being mounted on a distal end 77 of the first stub shaft 44 and clutch mechanism 47, are more completely described, in connection with FIG. 5, is mounted on the distal end 77. The first shaft 44 and second shaft 75 are each stabilized by a pair of spaced bearings, not shown, on either side of the swing arm 85, through which the first shaft 44 and the second shaft 75 extend with swing arm 85 being pivotal about shaft 75. The second stub shaft 75, which extends parallel to the first stub shaft 44, includes a second pulley 80, best shown in FIGS. 2 and 4, positioned medially of the second shaft 75, and being operatively coupled to the first pulley 48 by first belt 49 to transfer torque power from pulley 80 through the clutch mechanism 47 to the first shaft 44. A first idler 106 is spaced from the first pulley 48 and the second pulley 80 and is engaged with the first belt 49 and adjusted to maintain the belt 49 tight as well known in the art.

A third shaft 90A extends parallel to the first shaft 44 and the second shaft 75 and powers first driving roll 16 mounted on a proximal end 88 of the third shaft 90A. A driving pulley 87 is mounted on a distal end 89 of the third shaft 90A and is operatively coupled via belt 81 and pulley 82 and shaft 75 to the second pulley 80 to transfer rotative driving power via belt 49 through the clutch mechanism 47 to shaft 44. An idler 107 is positioned spacedly between the driving pulley 87 and pulley 82 to adjust and tighten the moving belt 81.

FIG. 4 is a side view showing the swing arm 85 including an elliptical housing 112, which has a flat front face 112A, flat back face 112B and ellipsoidal circumference 112C. The first stub shaft 44 extends through the flat front and the back faces 112A and 112B at a proximal end 114 of the housing 112. The accumulator roll 43 is secured to the proximal end 76 of the first stub shaft 44 by a nut 110 or the like. The clutch mechanism 47, which includes the first pulley 48, is mounted on the distal end 77 of the first stub shaft 44. A couple of spaced bearings, not shown, are positioned on either side of the housing 112 to stabilize the first stub shaft 44. The swing arm 85 has a pivoting axis 86 coincident with the axis of the second stub shaft 75. The swing arm 85 carries the first stub shaft 44 and the accumulator roll 43 in order to enable the first stub shaft 44 to move within the arcuate slot 37 between its inner end 38 and its outer end 39 in response to the thickness of the accumulating tape 20 layers wound around the accumulator roll 43 and at a speed adjusted by the clutch mechanism 47 mounted at the distal end 77 of the first stub shaft 44.

The second stub shaft 75 extends through the flat face 112A and back 112B of the housing 112 that includes a couple of bearings, including bearing 104, to stabilize the second stub shaft 75, and bearing 104 is mounted at a proximal end 78 of the second shaft 75, while the second pulley 80 is mounted generally midway of the second shaft 75 and a third pulley 82 is mounted at the distal end 79 of the second shaft 75. The second pulley 80 is coupled to the first pulley 48 by moving belt 49 to transfer torque from the second pulley 80 through the clutch mechanism 47 to the first stub shaft 44.

FIG. 5 shows the clutch mechanism 47 in detail, which adjusts the rotational speed of the accumulator roll 43 relative to the changing diameter 45 of the accumulator roll 43 due to the winding of the layers of the cutting tape 20 during accumulation of pre-determined single length of the tape 20 or due to the unwinding during release and dispensing of the tape 20 into a track 100 of the apparatus 101.

The clutch mechanism 47 is mounted on the distal end 77 of the first shaft 44 and includes the first pulley 48 disposed on a bearing 93 having a passage 111 through which end 77 of the shaft 44 extends. The second pulley 80 is mounted medially of the second shaft 75 that includes the third pulley 82 on the distal end 79 of the second shaft 75 for receiving rotative power from the driving pulley 83. The power is transferred from the third pulley 82 to the second pulley 80 and to the first pulley 48 via moving belt 49.

The first pulley 48 and bearing 93 are located on the first shaft 44 forwardly of four spaced depressions 94 forming races containing bearing elements 92 or the like. Cylindrical clutch body 95 having four spaced depressions 91 is mounted on the distal end 77 directly over bearing elements 92 so that a surface 95A of the clutch body 95 frictionally engages a slippage disk 48A mounted on the bearing 93 of the first pulley 48. Additionally, a cylindrical disk 96 is located with its surface 96A on the other surface 95B of the clutch body 95 with spring means 98 being between its surface 96B and a nut 99 threaded onto threaded portion 76A to press the surface 95A frictionally against the slippage disk 48A and 96A against surface 95B of clutch body 95. When the pulley 48 receives torque power through the driving pulley 80, the full rotative power is not transmitted axially immediately to the first shaft 44. Rather, power is transmitted to the shaft 44 through clutch mechanism 47 since the first pulley 48 transfers power via bearing elements 92 and thence to the shaft 44. Thus, a variable amount of rotative power is transmitted through friction between slippage disk 48A and disk 96 engaging the clutch body 95 and permitting slippage.

The clutch mechanism 47 is designed to change and adjust the rotating speed of accumulator roll 43 to provide smooth and even winding of the tape 20 around the roll 43 as its diameter 45 increases during the winding process or decreases during the unwinding process when the tape 20 is pulled out and away from the hollow 33 of the container 31. Also, the speed of the accumulator roll 43 is maintained faster than the linear speed of the tape 20 when the tape 20 winds onto the roll 43. The principles of operation of the type of clutch mechanism 47 are known in the art.

While the invention has been described with respect to certain specific embodiments, it will be appreciated that many modifications and changes may be made by those skilled in the art without departing from the spirit of the invention. It is intended therefore, by the appended claims to cover all such modifications and changes as fall within the true spirit and scope of the invention.

What is claimed as new and what is desired to secure by Letters Patents is:

1. In a system for dispensing a pre-determined single length of a cutting tape into a cross web track of an apparatus for cutting a moving web, said system comprising a first driving roll and a first cooperating press roll selectively movable toward and away from said first roll by an actuator, said first roll and first press roll sandwiching a cutting tape therebetween when said first press roll is moved toward said first roll and moving a cutting tape through a cutting station, a second driving roll and a second cooperating press roll selectively movable toward and away from said second roll by an actuator, said second driving roll being operatively coupled to said first driving roll, said second press roll receiving a cutting tape after passage through said cutting station with a cutting tape being sandwiched between said second roll and said second press roll for moving a cutting tape in one direction into an entryway of a container, said container including a hollow therein formed by a circumferential surface in which said entryway is located, said circumferential surface having a lateral slot therein located spacedly from said entryway, said hollow being formed by a plate extending laterally of said circumferential surface, said plate having an arcuate slot extending at its inner end generally medially of said plate to its outer end adjacent said lateral slot, a rotatable press roll having a fixed axis of rotation with its outer surface extending partially through said lateral slot beyond said circumferential surface of said hollow, an accumulator roll having a rotating first shaft extending through said arcuate slot with said accumulator roll being within said hollow and being located adjacent to and urged toward said rotatable press roll for receiving a cutting tape therebetween and wrapping a cutting tape around said accumulator roll, said accumulator roll rotating at a speed higher than the linear speed of a cutting tape entering said entryway, said accumulator roll being increased in diameter by a cutting tape wound therearound causing said first shaft to move from said outer end of said arcuate slot toward said inner end, said second driving roll and said press roll maintaining a cut end portion of a cutting tape therebetween with substantially its remainder wound on said accumulator roll, said second driving roll moving a cutting tape in another direction opposite to said one direction to pull a cutting tape from around said accumulator roll in a clockwise direction out of said entryway.

2. The system of claim 1 further including a clutch mechanism coupled to said accumulator roll for varying speed of rotation of said roll in an inverse proportion relative to said diameter of tape wound around said accumulator roll a first pulley spaced from said container and being operatively coupled to said clutch mechanism to transfer rotative power therethrough to said first shaft.

3. The system of claim 2 further including a second pulley mounted on a proximal end of a second stub shaft extending parallel to said first stub shaft, said second pulley on said second stub shaft being operatively coupled to said first pulley for providing torque through said clutch mechanism to said first shaft, said second pulley being mounted medially of said second shaft, said system further including a third pulley mounted on said distal end of said second shaft and being operatively coupled to a driving pulley.

4. The system of claim 3 further including swing arm having a pivoting axis in alignment with said second stub shaft, said swing arm carrying said first stub shaft and said accumulator roll to enable said first stub shaft to move within said arcuate slot.

5. The system of claim 3 further including a third shaft extending parallel to said first and second stub shafts, said first driving roll being mounted on a proximal end of said third shaft, said driving pulley being mounted on a distal end of said third shaft, said driving pulley being operatively coupled to said third pulley to transfer rotative power therebetween.

6. The system of claim 2 wherein said clutch mechanism includes a plurality of bearing elements located spacedly around said first stub shaft within depression races around said shaft, a cylindrical clutch bearing body located around said bearing elements and races, a friction disk engaged with one side of said clutch body and a slippage disk disposed between another side of said clutch body and said first pulley to permit transfer of torque to said shaft through said bearing elements while permitting slippage, spring means engaged between said disk and a fastener threaded onto said threaded distal end of said first stub shaft.

7. The system of claim 6 further including a clutch mechanism coupled to said accumulator roll for varying speed of rotation of said roll in an inverse proportion relative to said diameter of tape wound around said accumulator roll, a first pulley spaced from said container and being operatively coupled to said clutch mechanism to transfer rotative power therethrough to said first shaft.

8. The system of claim 7 further including a second driving roll and a second cooperating press roll selectively movable toward and away from said second roll by an actuator, said second driving roll being operatively coupled to said first driving roll, said second press roll receiving a cutting tape after passage through said cutting station with a cutting tape being sandwiched between said second roll and said second press roll, said second driving roll and said press roll maintaining a cut end portion of a cutting tape therebetween with substantially its remainder wound on said accumulator roll moving a cutting tape in another direction opposite to said one direction to pull a cutting tape from around said accumulator roll in a clockwise direction out of said entryway.

9. The system of claim 8 further including a reversible motor positioned spacedly upstream from said third driving roll and being coupled to said first, second and third driving rolls for providing rotative power thereto.

10. The system of claim 9 wherein said first shaft is an elongated stub shaft with its proximal end carrying said accumulator roll, said clutch mechanism being mounted on a distal end of said shaft and being spaced rearwardly from said accumulator roll.

11. The system of claim 10 further including a swing arm having a pivoting axis in alignment with said second stub shaft, said swing arm carrying said first stub shaft and said accumulator roll to enable said first stub shaft to move within said arcuate slot.

12. The system of claim 11 wherein said clutch mechanism includes a plurality of bearing elements located spacedly around said first stub shaft within spaced depression races around said shaft, a cylindrical clutch bearing body located around said bearing elements and races, a friction disk engaged with one side of said clutch body and a slippage disk between another side of said clutch body and said first pulley to permit transfer of torque to said shaft through said bearing elements while permitting slippage, spring means engaged between said disk and a fastener threaded onto said threaded distal end of said first stub shaft.

13. The system of claim 6 further including a first driving roll and a first cooperating press roll selectively movable toward and away from said first roll by an actuator, said first roll and first press roll sandwiching a cutting tape therebetween when said first press roll is moved toward said first roll and moving a cutting tape through said cutting station.

14. The system of claim 13 further including a third driving roll and a third cooperating press roll selectively movable toward and away from said third driving roll by an actuator, said third driving roll and third press roll sandwiching a cutting tape therebetween when said third press roll is moved toward said third driving roll and moving a cutting tape through a cross web track of an apparatus for cutting a moving web, said third driving roll being operatively coupled to said first and second driving rolls.

15. The system of claim 14 further including a fourth roll freely rotatable in either direction to assist said second driving roll in moving a cutting tape inwardly and outwardly of said entryway, said fourth roll being positioned adjacent said entryway and spaced from said second driving roll.

16. The system of claim 15 further including a second pulley mounted on a proximal end of a second stub shaft extending-parallel to said first stub shaft, said second pulley on said second stub shaft being operatively coupled to said first pulley for providing torque through said clutch mechanism to said first shaft, said second pulley being mounted medially of said second shaft, said system further including a third pulley mounted on said distal end of said second shaft and being operatively coupled to a driving pulley.

17. The system of claim 16 further including a third shaft extending parallel to said first and second stub shafts, said first driving roll being mounted on a proximal end of said third shaft, said driving pulley being mounted on a distal end of said third shaft, said driving pulley being operatively coupled to said third pulley to transfer rotative power therebetween.

18. The system of claim 1 further including a third driving roll and a third cooperating press roll selectively movable toward and away from said third roll by an actuator, said third roll and third press roll sandwiching a cutting tape therebetween when said third press roll is moved toward said third roll and moving a cutting tape through a cross web track of an apparatus for cutting a moving web, said third driving roll being operatively coupled to said first and second driving rolls.

19. The system of claim 18 further including an adhesive applicator to apply a strip of double-sided pressure sensitive adhesive to a lower surface of a cutting tape, said applicator being positioned upstream from said third driving roll.

20. The system of claim 19 wherein said applicator includes a housing having an upper portion and a lower portion, a rotatable spindle for receiving a supply roll having layers of spaced strips with exposed face sides and unexposed back sides with each side having a pressure sensitive adhesive thereon and with back sides being adhered to an elongated continuous release liner having a release coating on both its faces, said spindle being positioned generally medially of said upper portion, a stationary nose member mounted to said housing and having a rounded tip exposed outwardly of said housing and being disposed at a proximal end of said upper portion of said housing above said spindle and any supply roll disposable thereon, a solenoid activated press roll positioned diametrically opposite and above said rounded tip and being vertically movable downwardly to force an exposed face side of an adhesive strip on said rounded tip into contact with a lower surface of a generally horizontally incoming cutting tape to cause an exposed face side to adhere to a lower surface of a cutting tape and separate from a release liner when a release liner rotates around said tip, a rotatable nip roll spacedly positioned beneath a supply roll for pressing spent release liner onto a supply roll, a doctor knife edge positioned spacedly and adjacent said nip roll and beneath a supply roll for separating spent release liner from exposed face sides of strip around a supply roll while said nip roll presses against a supply roll, an optical sensor for controlling the movement of said solenoid activated press roll downwardly to press into contact a lower surface of a cutting tape with an exposed face side of an adhesive strip.

21. The system of claim 20 further including another optical sensor positioned downstream in proximity with said stationary nose member for detecting presence or absence of adhesive strip on a lower surface of a generally horizontally exiting cutting tape, and an abort block means selectively movable downwardly and being positioned adjacent said cross web track, and a controller for receiving output signals from said sensor and sending a signal to said abort block means to move downwardly to divert a cutting tape having no adhesive strip on its lower surface for disposal.

22. The system of claim 1 further including a reversible motor positioned spacedly upstream from said third driving roll and being coupled to said first, second and third driving rolls for providing rotative power thereto.

23. The system of claim 1 further including a fourth roll freely rotatable in either direction to assist said second driving roll in moving a cutting tape inwardly and outwardly of said entryway, said fourth roll being positioned adjacent said entryway and spaced from said second driving roll.

24. The system of claim 1 wherein said first shaft is an elongated stub shaft with its proximal end carrying said accumulator roll, said clutch mechanism being mounted on a distal end of said shaft and being spaced rearwardly from said accumulator roll.

25. In a system for dispensing a pre-determined single length of a cutting tape into a cross web track of an apparatus for cutting a moving web, said system comprising a cutting station for cutting a pre-determined single length of a cutting tape, a container for receiving a pre-determined single length of a cutting tape selectively movable in one direction into an entryway of said container and thereafter in another opposite direction to said one direction to pull a cutting tape out of said entryway, said container including a hollow therein formed by a circumferential surface in which said entryway is located, said circumferential surface having a lateral slot therein located spacedly from said entryway, said hollow being formed by a plate extending laterally of said circumferential surface, said plate having an arcuate slot extending at its inner end generally medially of said plate to its outer end adjacent said lateral slot, a rotatable press roll having a fixed axis of rotation with its outer surface extending partially through said lateral slot beyond said circumferential surface of said hollow, an accumulator roll having a rotating first shaft extending through said arcuate slot with said accumulator roll being within said hollow and being located adjacent to and urged toward said rotatable press roll for receiving a cutting tape therebetween and wrapping a cutting tape around said accumulator roll, said accumulator roll rotating at a speed higher than the linear speed of a cutting tape entering said entryway, said accumulator roll being increased in diameter by a cutting tape wound therearound causing said first shaft to move from said outer end of said arcuate slot toward said inner end.

26. A method for accumulating a pre-determined single length of a cutting tape and dispensing a free end of a cutting tape into a cross web track of an apparatus for cutting a moving web, said method comprising the steps of:

A. moving a cutting tape into an entryway of a container having a hollow therein formed by a circumferential surface in which the entryway is located;

B. sandwiching a cutting tape between a rotatable fixed axis press roll with its outer surface extending partially through a lateral slot formed in the circumferential surface beyond such surface and an accumulator roll;

C. driving the accumulator roll through a shaft extending through an arcuate slot in the container with an inner end of the slot being medially of the hollow and an outer end being adjacent the lateral slot;

D. wraping a cutting tape around the accumulator roll within the hollow;

E. increasing the effective diameter or the accumulator roll by a cutting tape being wound therearound; and F. urging the shaft of the accumulator roll to move from the outer end of the arcuate slot toward the inner end.

27. The method of claim 26 further including the step:

G. adjusting the speed of the accumulator roll relative to the linear speed of the cutting tape.

28. The method of claim 26 further including the step of:

G. urging the shaft of the accumulator roll toward the press roll during step D.

29. The method of claim 26 further including the step of:

G. advancing a free end of a cutting tape wound around the accumulator roll into the cross web track of the apparatus for cutting a moving web and unwinding the wound cutting tape from the accumulator roll.

30. The method of claim 29 further including the step of:

H. applying a double-sided pressure sensitive adhesive strip to a lower surface of a cutting tape prior to a cutting tape entering the cross web track.

31. The method of claim 30 further including the steps of:

I. detecting the presence or absence of pressure sensitive adhesive strip on the lower surface of the cutting tape; and J. upwardly moving an abort block downwardly to divert an incoming cutting tape having no adhesive strip on its lower surface.

32. The method of claim 26 further including the steps of:

G. adjusting the speed of the accumulator roll relative to the linear speed of the cutting tape;

H. urging the shaft of the accumulator roll toward the press roll during step D;

I. applying a double-sided pressure sensitive adhesive strip to a lower surface of a cutting tape prior to a cutting tape entering the cross web track;

J. detecting the presence or absence of pressure sensitive adhesive strip on the lower surface of the cutting tape;

K. upwardly moving an abort block downwardly to divert an incoming cutting tape having no adhesive strip on its lower surface; and L. advancing a free end of a cutting tape wound around the accumulator roll and having an adhesive strip into the cross web track of the apparatus for cutting a moving web and unwinding the wound cutting tape from the accumulator roll.

* * * * *